US005298280A

United States Patent [19]

Kaczur et al.

[11] Patent Number: 5,298,280

[45] Date of Patent: Mar. 29, 1994

[54] PROCESS FOR PRODUCING AN ELECTRODE BY ELECTROLESS DEPOSITION

[75] Inventors: Jerry J. Kaczur; David W. Cawlfield, both of Cleveland; Julian F. Watson, Delano, all of Tenn.

[73] Assignee: Olin Corporation, Cheshire, Conn.

[21] Appl. No.: 739,041

[22] Filed: Aug. 1, 1991

Related U.S. Application Data

[63] Continuation-in-part of Ser. No. 456,437, Dec. 26, 1989, Pat. No. 5,041,196.

[51] Int. Cl.[5] ..... B05D 5/12

[52] U.S. Cl. ..... 427/125; 427/309; 427/328; 427/443.1

[58] Field of Search ..... 204/95, 98, 101, 103, 204/129, 290 R, 292; 427/431, 443.1, 125, 299, 307, 309, 328; 106/1.24

[56] References Cited

U.S. PATENT DOCUMENTS

| | | | |
|---|---|---|---|
| 2,163,793 | 6/1939 | Logan | 204/9 |
| 2,717,237 | 9/1955 | Rempel | 204/10 |
| 3,674,675 | 4/1972 | Leaman | 204/290 R |
| 4,456,510 | 6/1984 | Murakami et al. | 204/101 |
| 4,542,008 | 9/1985 | Capuano et al. | 423/477 |
| 4,683,039 | 7/1987 | Twardowski et al. | 204/95 |
| 4,806,215 | 2/1989 | Twardowski | 204/98 |
| 4,853,096 | 8/1989 | Lipsztajn et al. | 204/101 |
| 4,902,535 | 2/1990 | Garg et al. | 427/443.1 |
| 5,041,196 | 8/1991 | Cawlfield et al. | 204/101 |
| 5,084,149 | 1/1992 | Kaczur et al. | 204/101 |

FOREIGN PATENT DOCUMENTS

| | | |
|---|---|---|
| 31-153 | 3/1956 | Japan . |
| 56-158883 | 12/1981 | Japan . |

OTHER PUBLICATIONS

Chemical Abstracts 103: 94994x Sep. 23, 1985.

Chemical Abstracts 108 228320p Jun. 27, 1988.

"Chlorine Dioxide Chemistry and Environmental Impact of Oxychlorine Compounds", published 1979 by Ann Arbor Science Publisher's Inc., p. 130.

*Primary Examiner*—Kathryn Gorgos

*Attorney, Agent, or Firm*—William A. Simons; H. Samuel Keiser

[57] ABSTRACT

A process for fabricating a porous, high surface area electrode and the use of that electrode in an electrolytic cell for manufacturing chlorine-free chlorine dioxide from dilute alkali metal chlorite solutions in a single step is disclosed. The electrolytic cell uses a porous flow-through anode and a cathode separated by a suitable separator.

17 Claims, 8 Drawing Sheets

2000 X

8000 X

1600 X

8000 X

8000 X

PROCESS FOR PRODUCING AN ELECTRODE BY ELECTROLESS DEPOSITION

This application is a continuation-in-part of application Ser. No. 07/456,437, filed Dec. 26, 1989, now U.S. Pat. No. 5,041,196.

BACKGROUND OF THE INVENTION

This invention relates generally to the production of chlorine dioxide. More particularly the present invention relates to the method of fabricating a coated electrode and the particular anode structure used in the electrochemical process to manufacture chlorine-free chlorine dioxide from dilute alkali metal chlorite solutions in an electrolytic cell. Chlorine dioxide is commercially employed as a bleaching, fumigating, sanitizing or sterilizing agent.

Chlorine dioxide can be used to replace chlorine and hypochlorite products more traditionally used in bleaching, sanitizing or sterilizing applications with several resulting benefits. Chlorine dioxide is a more powerful sterilizing agent and requires lower dosage levels than chlorine at both low and high pH levels, although it is not particularly stable at high pH levels. Chlorine dioxide produces lower levels of chlorinated organic compounds than chlorine when sterilizing raw water. Additionally, chlorine dioxide is less corrosive than chlorine to metals and many polymers.

A disadvantage of the prior electrolytic processes used to produce chlorine dioxide is the fact that the chlorine dioxide is produced in the anode compartment of the cell. This requires that the chlorine dioxide be recovered from the anolyte by stripping with air or some other appropriate means to obtain a suitably high conversion rate of chlorite to chlorine dioxide in the electrolyte of typically greater than 20% to make the direct use of the anolyte economically feasible. Attempts to obtain higher conversion rates by operating these electrolytic processes under conditions where more current and lower electrolyte feed rates are employed results in the formation of chlorate and/or free chlorine. Since chlorine is an undesirable contaminant and the formation of chlorate is irreversible, there has been developed a process by which chlorite can be converted to chlorine dioxide efficiently without a separation step.

The use of air stripping as one step in a multi-step purification process to obtain chlorine-free chlorine dioxide is also done in conjunction with the reabsorbing of chlorine dioxide from a generating solution to a receiving solution. This type of a process, however, can be hazardous if the chlorine dioxide concentrations in the air become high enough to initiate spontaneous combustion. Use of a gas-permeable hydrophobic membrane in a purification process has also been developed, but requires costly additional equipment.

Attempts to further significantly enhance the chlorite to chlorine dioxide conversion rate has focused on improved high surface area electrodes, especially anodes, for use in a direct continuous electrochemical process. Concurrently, there has been an increasing need for high selectivity electrodes to achieve higher electrochemical process efficiencies. One of the major technological challenges in producing such an electrode is the efficient coating of the high surface area electrode structure with electroactive metals and/or oxides while using economical amounts of the electroactive coating materials in the electrode structure. This is especially important when the specific surface area of the electrode is very high, such as greater than about 10–25 $cm^2/cm^3$, and the electrocatalyst applied to the electrode surface is expensive.

There are many well known and established techniques and methods for the electrodeposition or electroplating of precious metals onto various metallic substrates, using DC current as the driving force for the plating. However, it is difficult to plate or coat structures that are three dimensional and have significant depth, such as metallic felts composed of fibers, ribbons, or woven structures which, when fabricated into electrodes, present high specific surface areas of greater than about 10 to about 25 $cm^2/cm^3$.

Electroplating also suffers from the disadvantage of having very limited throwing power, that is the ability of a plating bath to produce deposits of more or less uniform thickness on a substrate structure that has irregularities over the entire surface of the structure. This is especially true on the microscopic scale. Microscopic peaks and valleys on the electrode surface, on the order of microns or less, are not plated evenly because surface projections coat more readily than depressions or crevices. This is due to the difference in plating potentials caused by distance, bulk film layer effects, and concentration/polarization effects. Methods to decrease these effects using chemical agents or current control have been developed, but they still cannot match the plating uniformity of the electroless plating methods.

Electroplating is one technique that could be successfully applied to plate spools of continuous length individual conductive fibers or conductive tow fibers in a reel to reel type of process through a series of baths using properly placed electrodes. However, this process would be difficult to use for plating short or variable length fibers that are not on a continuous spool, such as the melt spun metallic fibers employed in the contemplated electrode structure.

There are also secondary problems caused by hydrogen embrittlement of the fiber structure and coating when using electroplating. Hydrogen is a by-product in the electroplating process that can become incorporated into the coating and substrate. Where titanium is employed, a brittle titanium hydride compound is formed on the electrode surface that will flake off of the surface. If produced in sufficiently large quantities, the titanium hydride formation will destabilize the plated coating by forming voids under the coating, followed by eventual loss by flaking off. This occurs when direct electroplated platinum coatings are made in dilute chloroplatinic solutions. There are dark gray deposits that are found in the solution after electroplating that also rub off of the plated fibers upon handling. The loose deposits, when analyzed by x-ray fluorescence, are shown to contain platinum and titanium.

Another alternative electroplating method to obtain a precious metal plating distribution in a three dimensional felt material can mount the felt against a cathode conductor plate and pass the plating solution through the felt structure. If current is applied at low current density levels, a better plating distribution on the fibers in the felt can be obtained. However, a major disadvantage of this method is that the current levels must be so low (about 1–30 $ma/cm^2$) to get an even plating that the process may take many hours to complete. Also a significant portion of the plated metal builds up on the conductor backplate. In this method especially, the use of excess precious metal in the plating process is costly.

Electroless deposition techniques have several advantages over electroplating. More uniform deposits with no excessive buildup on projections or edges are obtained. Electroless deposits can display unique chemical, mechanical and magnetic properties and are often less porous than electroplated deposits.

Electroless precious metal plating methods are well known. The most common types plate electroless nickel, copper, gold and palladium. But electroless plating methods for platinum on metals are especially rare because of the plating properties of platinum and the substrates onto which the precious metals are deposited. Achieving a high rate of electrocatalytic performance in view of the percentage of the surface area covered by the platinum or other precious metal plating of a high surface area electrode is a continuing problem. Another concern is the cost of the quantity of precious metal used to complete the coating.

Further, the physical and chemical characteristics of the electrocatalyst coatings and their placement on the electrode surface affect the performance of high surface area electrodes. These include features such as the size and crystallinity of the electrocatalyst material. The chemical and mechanical stability of the electrocatalyst material on the particular electrode substrate is also important and is often affected by the chemical characteristics of the solution environment of the electrochemical process. Oxidation reactions in strong, hot acidic solutions are particularly aggressive environments that affect the effective lifespan of coatings. High current densities also are known to shorten the effective life of an electrocatalyst coating.

Lastly, the substrate onto which the electrocatalyst is deposited can present special coating problems, such as the formation of a stable protective oxide film on the surface that must be removed prior to coating with the electrocatalyst. This is especially true with stable conductive metallic substrates, such as the valve metals of titanium, niobium, zirconium or tantalum that form these oxide films.

These and other problems are solved in the present invention by the improved process to produce an improved electrode and by employing an improved porous flow-through anode structure made by the process in an electrolytic cell using a continuous electrochemical process to produce a chlorine-free chlorine dioxide from dilute alkali metal chlorite solutions in a single step.

SUMMARY OF THE INVENTION

It is an object of the present invention to provide a process to produce a precious metal coated high surface area electrode that may be used in an electrochemical cell.

It is another object of the present invention to provide an improved electrode for use in an electrolytic process and apparatus. It may be used in a process that produces a chlorine dioxide solution from aqueous chlorite directly from an electrochemical cell without the need for further recovery steps of the product chlorine dioxide.

It is still another object of the present invention to provide an improved electrode for use in an electrolytic cell in a process that can be controlled to produce a controlled concentration and quantity of chlorine dioxide containing solution.

It is a further object of the present invention to provide a process to produce an improved electrode for use in an electrolytic cell that can be employed in a process for electrolytically producing chlorine dioxide solutions that are substantially free of chlorine and which contain minimal amounts of chlorite and chlorate salts.

It is a feature of the present invention that the improved porous, high surface area, flow-through electrode can be an anode which has fine valve metal composition fibers as a substrate that is electrolessly coated with a precious metal coating.

It is another feature of the present invention that suitable electrodes produced by the process of the present invention have a void fraction, defined as the percentage of total electrode volume that is not occupied by electrode material, of greater than about 40%.

It is still another feature of the present invention that the electrode produced by the process of the present invention has an electrode structure fill density that is less than about 60% with specific surface areas having a surface area to volume ratio of greater than about 10 $cm^2/cm^3$.

It is yet another feature of the present invention that a high surface area valve metal electrode substrate, such as 12 micron titanium fiber felt, is electrolessly plated with a platinum coating in a controlled surface coverage pattern.

It is still another feature of the present invention that the distribution of a precious metal electrocatalyst on the high surface area electrode substrate is geometrically structured, preferably microspherically, so that while only a relatively low percentage of the surface area of the electrode is coated, an effective catalytic reaction is obtained when the electrode is used in a process. This provides a high conversion efficiency in an electrolytic cell system when converting, for example, chlorite to chlorine dioxide in a single pass electrolyte flow pattern.

It is a further feature of the present invention that the catalytically effective surface area of the electrocatalyst is determined by the size of the geometric structures and the number of such structures per unit area on the electrode substrate surface.

It is an advantage of the present invention that an electroless deposited coating is obtained on the high surface area valve metal substrate that maximizes the exposed surface area of the electrocatalyst.

It is another advantage of the present invention that no excessive precious metal deposits build up on the high surface area valve metal fiber substrate during the plating process.

It is still another advantage of the present invention that the minimum necessary quantity of expensive precious metal catalyst is deposited on the high surface area electrode surface to obtain the desired electrochemical process performance.

These and other objects, features and advantages of the present invention are provided in the improved electrode structure and the multiple step process to coat a high surface area metal substrate with a precious metal.

BRIEF DESCRIPTION OF THE DRAWINGS

These and other objects, features and advantages of the invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
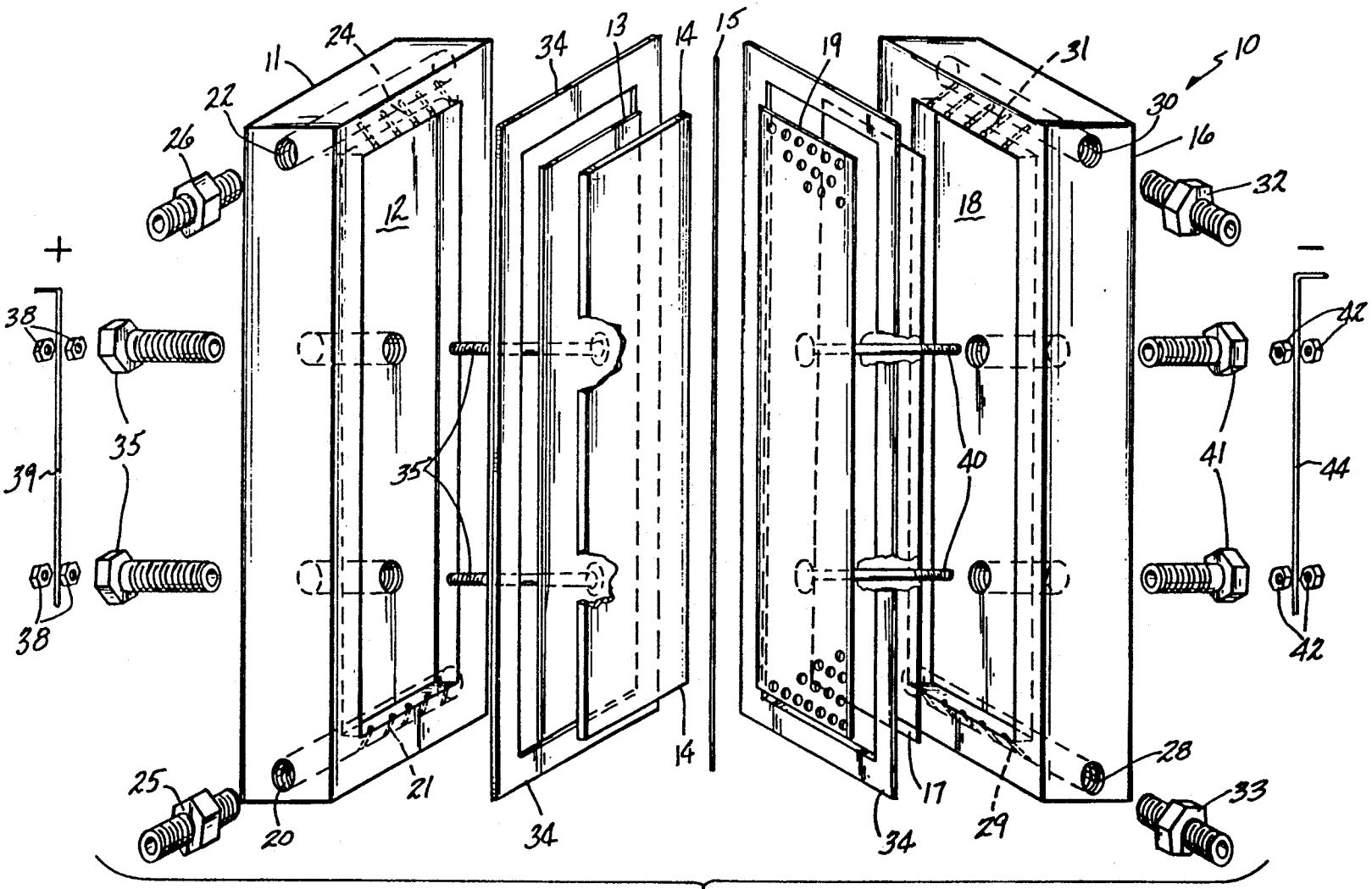
FIG. 1 is an exploded side elevational view of the electrolytic cell.
Figure 2:
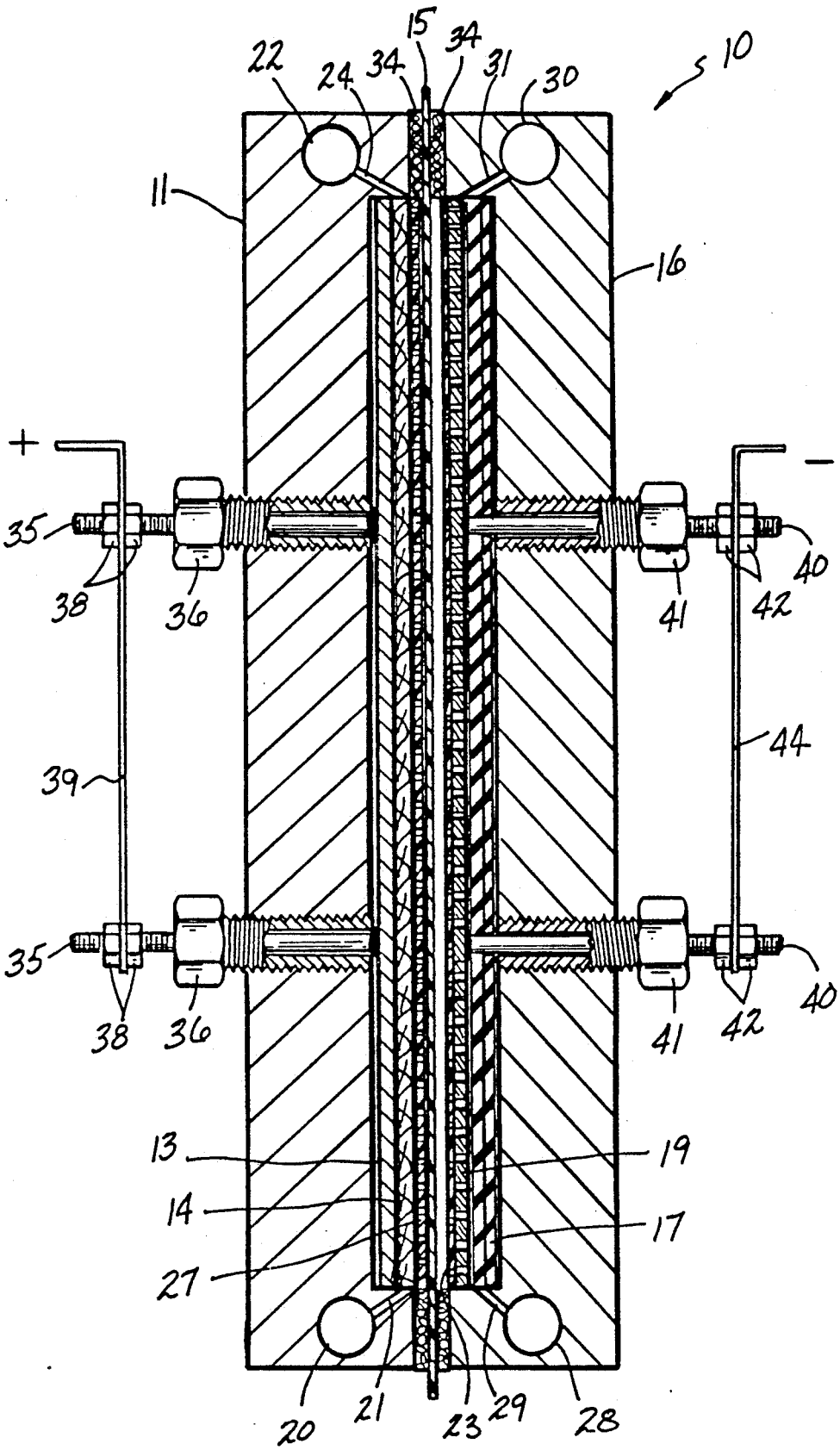
FIG. 2 is a sectional side elevational view of the electrolytic cell, but with the structure not in its fully compressed and assembled position.

The electrochemical cell indicated generally by the numeral 10 is shown in FIG. 1 in exploded view and in FIG. 2 in an assembled view.

The electrochemical cell 10 is divided into an anolyte compartment 12 and catholyte compartment 18 by an oxidation resistant cation permeable ion exchange membrane 15. Appropriate sealing means, such as gaskets 34 or an O-ring, are used to create a liquid-tight seal between the membrane 15 and the anode frame 11 and the cathode frame 16.

The cathode side of the cell 10, in addition to the frame 16 and the compartment 18, includes a cathode 19 and a hydrogen gas disengaging material 17 fitted within the compartment 18. The cathode 19 is an electrode made of suitable material, such as smooth, perforated stainless steel. The cathode 19 is positioned flush with the edge of the cathode frame 16 by the use of the disengaging material 17, which is porous and physically fills the space between the inside portion of the frame 16 and the cathode 19.

Cathode conductor posts 40 transmit electrical current from a power supply (not shown) through current splitter wire 44 and cathode conductor post nuts 42 to the cathode 19. Cathode conductor post fittings 41 extend into the cathode frame 16 about posts 40 to seal against posts 40 and prevent the leakage of catholyte from the cell 10.

The preferred structure of the cathode 19 is a smooth, perforated, stainless steel of the grade such as 304, 316, 310,and the like. The perforations should be suitable to permit hydrogen bubble release from between the membrane 15 and the cathode 19. Other suitable cathode materials include nickel or nickel-chrome based alloys. Titanium or other valve metal cathode structures can also be used. A corrosion resistant alloy is preferred to reduce formation of some localized iron corrosion byproducts on the surface of the cathode 19 due to potential chlorine dioxide diffusion through the membrane 15 by surface contact with the cathode 19. Other suitable materials of construction for the cathode 19 include fine woven wire structures on an open type metal substrate, which can help to reduce the cell voltage by promoting hydrogen gas bubble disengagement from the surface of the cathode 19.

The anode side of the cell 10, in addition to the frame 11 and the compartment 12 of FIG. 1, includes a porous, high surface area anode 14 and an anode backplate or current distributor 13 fitted within the compartment 12. The anode 14 is an electrode made of a suitable porous and high surface area material, which increases the rate of mass transport into and away from the anode electrode surface. The high surface area anode 14 distributes the current so that the rate of charge transfer from the electrode to the anolyte solution is much lower than the rate of charge transfer through the membrane and the bulk electrolyte. Materials with a surface area to volume ratio of about 50 $cm^2/cm^3$ or higher are suitable to achieve a high percentage chlorite to chlorine dioxide conversion, with higher surface area to volume ratios being more desirable up to the point where pressure drop becomes critical. The anode must be sufficiently porous to permit anolyte to pass through it during operation. The porosity must also be sufficient so that the effective ionic conductivity of the solution inside the electrode is not substantially reduced. Anodes with a void fraction of greater than about 40% are desirable to accomplish this.

The anode 14 is positioned flush with the edge of the anode frame 11 by the use of the high oxygen overvoltage anode current distributor 13, which physically fills the space between the inside portion of the frame 11 and the anode 14. The nature of the compressible, high overvoltage, porous and high surface area anode 14 also helps to fill the space within the anolyte compartment 12 and obtain alignment with the edges of the anode frame 11.

Anode conductor posts 35 transmit electrical current from a power supply (not shown) through current splitter wire 39 and anode conductor post nuts 38 to the anode 14. Anode conductor post fittings 36 extend into the anode frame 11 about posts 35 to seal against posts 35 and prevent the leakage of anolyte from the cell 10.

The anode current distributor or backplate 13 distributes the current evenly to the flexible and compressible porous, high surface area anode 14 which does most of the high efficiency electrochemical conversion of the chlorite solution to chlorine dioxide. High oxygen overvoltage anode materials and coatings are preferably used to increase current efficiency by decreasing the amount of current lost during the electrolysis of water to oxygen and hydrogen ions on the anode surface.

The high oxygen overvoltage, high surface area anode 14 is prepared by a five step plating process. While this process will be described with respect to the plating of an anode with a platinum coating, it is to be understood that the process is equally applicable to the plating of a cathode and/or the use of precious metals other than platinum. Precious metals such as gold, silver, iridium, osmium, palladium, rhodium, or ruthenium alloyed with platinum group metals could also be acceptable. Appropriate electrode substrate surface materials include platinum, gold, palladium, or mixtures or alloys thereof, or thin coatings of such materials on various substrates. For example, platinum electroplated on titanium or a platinum clad material could also be utilized for the anode 14 in conjunction with a gold, platinum or oxide coated titanium current distributor 13. A thin deposited Platinum conductive coating or layer on a high surface area titanium fiber structure, however, is the preferred structure.

The preferred structure of the anode 14 is a porous high surface area material of a compressible felt or reticulate construction. The anode 14 is preferably prepared by use of a multi-step process that includes the steps of the electrode substrate preparation; surface preparation; formulation of an appropriate plating solution containing the precious metal to be coated and reducing agents or other additives to promote the plating process; depositing the precious metal onto the electrode substrate under controlled temperature, concentration, pH and agitation conditions; and optional post deposition treatment methods to promote adhesion of the coating to the electrode substrate. Each of these steps will now be described in detail.

The first process step is the formation of either the entire electrode structure or its component fiber parts. The final structure form can be a felted mat, multiple layers of flexible woven material, knitted, or loose compressed fill. Various coating base structural compositions are listed in the copending application Ser. No. 07/456,437, filed Dec. 26, 1989, hereby specifically incorporated by reference in pertinent part.

The second process step is to remove the naturally occurring protective oxide film from the valve or oxide forming metal substrate, such as titanium, niobium, zirconium, or tantalum. These stable protective oxide films must be removed before any electrocatalyst metals can be deposited or plated onto the metal surface. In the case of titanium, a titanium oxide ($TIO_2$) film is present on the titanium surface. An acid etch is preferred, such as hot concentrated HCl, to both remove or dissolve the oxide film and to produce a roughened surface on the titanium fiber substrate onto which is plated the electrocatalyst metal, such as platinum. The choice of acids depends upon the substrate surface texture and surface area required for the electrochemical process application, but can also include hydrofluoric, sulfuric or oxalic acid as a partial listing. After the surface oxide is sufficiently etched by immersing the electrode substrate in the acid etch, the acid is rinsed from the electrode surface using deionized water. Then the etched substrate is immediately placed into the plating bath. The acid bath and a deionized water rinse can be carried out in an inert atmosphere, such as nitrogen or argon, to reduce the amount of any new oxide formation on the surfaces of the etched electrode structure. The deionized water can also be purged with nitrogen before use.

The third process step is the formulation of the two part plating solution. The first part is a precious metal salt in this instance which is in the form of an acidic chloroplatinic acid solution which is diluted and then pH adjusted to about a pH of about 2.0. This is done to reduce the total acidity of the final two part mixed plating bath. Too low of an acidity, combined with a large amount of chlorides, produces a plating solution in which the platinum will stay in solution and will not be reduced onto the surfaces of the electrode substrate.

The second part of the plating solution is the reducing agent which changes the precious metal salt to the metallic form that is the coating on the substrate. The preferred reducing agents are water soluble hydrazine salts. Most preferred are the chloride salts. The molar ratio of reducing agent to the chloroplatinic acid can range from about 0.1:1 to about 500:1, with a more preferred range of about 0.25:1 to about 250:1 and a most preferred range of about 0.5:1 to about 100:1.

The two parts of the plating solutions are then mixed together and diluted to obtain a platinum metal concentration of between about 0.01 to about 100 gpl, more preferably about 0.05 to about 50 gpl and most preferably between 0.1 to 20 gpl.

The total reaction for the chemical deposition of platinum from chloroplatinic acid using hydrazine dihydrochloride as the reducing agent is given in equation (1) below:

$$H_2PtCl_6+N_2H_4.2HCl \rightarrow 8HCl+Pt+N_2 \quad (1)$$

The half reactions are as follows:

$$N_2H_4.2HCl \rightarrow 2HCl+4H^+4e^-+N_2 \quad (2)$$

$$H_2PtCl_6+4e^- \rightarrow 2HCl+Pt+4Cl^- \quad (3)$$

$$4Cl^-+4H^+ \rightarrow 4HCl \quad (4)$$

Appropriate water soluble precious metal salts that may be used in the plating process include bromides, bromates, chlorides, chlorates, perchlorates, cyanides, iodides, nitrogen based salts including nitrites and nitrates, phosphates and sulfates.

The high surface area electrode substrate or its component parts are then either added to the solution or the solution is added to the electrode in the fourth process step. The plating solution temperature may be from about 5° C. to about 150° C., more preferably about 10° C. to about 120° C., and most preferably about 15° C., to about 105° C. Suitable atmospheric pressure is needed to achieve temperatures higher than about 100° C. The pressure ranges are greater than between about 1.0 and about 500 psig, more preferably greater than about 1.025 and about 250 psig, and most preferably between about 1.05 and about 100 psig. The plating solution is preferably hot, in a temperature range of about 50° to about 90° C., with the electrode substrate added to the solution. Higher temperatures are required to permit the combined action of the acidity and the reducing agent to plate the platinum onto the electrode surfaces within reasonable times. The pH of the plating bath can range from 0.01 to about 7.0, more preferably from about 0.1 to about 5.0, and most preferably from about 0.2 to about 4.0.

The plating time will be a function of the plating concentrations, the plating bath acidity, electrode surface area available for plating, and plating solution temperature. The plating times can vary from a few minutes to as long as about 24 to about 48 hours, depending upon difficulties encountered in plating onto the substrate surfaces.

The plating process is completed when the platinum content in the plating solution is reduced to the desired level. Since platinum is expensive, it is desirable to have at least about 95% or more of it plated onto the surfaces of the electrode. The amount of plating can be checked during the plating process by taking spot or "grab" samples of the plating solution that are treated with dilute NaOH to make them alkaline. The formation of black precipitate indicates the presence of platinum, while the quantity indicates the amount. Other analytical methods to track the concentration of the platinum during the plating process can be used, such as x-ray fluorescence (XRF), atomic absorption (AA) spectroscopy and the like.

Once the plating is determined to be completed, the electrode substrate is then rinsed in deionized water and dried. As an alternative, the coated electrode structure can be neutralized of any acidity by immersion into a dilute alkali bath, such as NaOH, and then rinsed with deionized water.

The electrode structure can then be employed directly in an electrochemical cell or fabricated into a suitable electrode structure after plating its component parts with the selected electrocatalyst.

Optional high surface area electrode post treatment methods may be employed to promote adhesion of the electrodeposited coating to the substrate, such as by heat annealing or alloying under vacuum or chemical treatments. A second plating procedure with the same or different metals, such as gold, silver, ruthenium, palladium, and the like may be employed. One technique can employ vacuum heat treatment at temperatures greater than about 600° C. to promote the formation of an intermediate bond between the platinum catalyst and the electrode substrate. Annealing or alloying temperatures can range from about 200° C. to about 1000° C., depending on the metals involved. For example, where platinum has been deposited onto a titanium substrate, the alloying temperature could be from about 400° C. to about 750° C. for periods of time lasting from a few minutes to hours in a vacuum or inert gas furnace.

Chemical treatments or a second plating procedure with the same or different metals can also be done to provide a unique combination of electrocatalyst surfaces. Chemical treatments could incorporate treatments for removal of any contaminants, such as anions, for example chlorides, from the structure. This can be done in boiling water solutions or by the addition of chemicals. Also, post etching of the crystalline faces of the electrocatalyst with chemicals may be useful.

Selected chemical reducing agents may be used in the plating solution bath. These include hypophosphites, formaldehyde, hydrazine, formic acid, borohydride, and amine boranes and all of their derivatives and salts, both inorganic and organic. These anion salts include chlorides, sulfates, phosphates, etc. Hydrazine and its salts are preferred because some of the other reducing agents may add a coprecipitated compound with the metal, such as phosphorous with use of the hypophosphite, and boron with the use of borohydride. When hydrazine is used, nitrogen is released and few other impurities are incorporated with the deposited metal. Some other impurities may be added from the plating solution components, such as chloride (Cl—) in a plating solution containing HCl-based hydrazine salts.

Additional plating bath constituents can include wetting, complexing and other common bath addition agents. The wetting agents promote the detachment of bubbles that might adhere to the substrate surfaces and help to make a more uniform plated surface. Suitable wetting agents include the sulfonic acid salts, such as benzene sulfonic acid, or other nonionic types of wetting agents.

Complexing agents may be added to reduce the effects of impurities in the bath or in the electrode material. Suitable complexing agents include EDTA (ethylenediaminetetracetic acid) salts and amines such as ethylamine.

Plating bath addition agents are chemicals that are added to the bath to promote or influence the crystalline form or structure of the deposits. Examples of these are phosphates, sulfates or chlorides. Other types of addition agents can be other salts, such as sodium fluoride or sodium chloride, which may enhance the plating process on the surfaces of the electrode structure by etching.

Agitation or mixing helps to provide for more uniform deposition of the precious metal coatings on the high surface area electrode structures. When hydrazine dihydrochloride is used as the reducing agent, agitation helps to dislodge nitrogen bubbles formed on the metallic fiber surfaces during the reduction process. Agitation or mixing generally increases the mass transfer of the reagents to the surfaces to be plated.

The anode backplate or current distributor 13 can be made of a graphite material which can be surface treated with agents such as those used on the porous, high surface area anode material. Other alternative materials suitable for use in the current distributor include metallic films or oxides on stable, oxidation chemical resistant valve metal structures such as titanium, tantalum, niobium, or zirconium. The coating types are metallic platinum, gold, or palladium or other precious metal or oxide type coatings. There are other oxides such as ferrite based and magnesium or manganese based oxides which may be suitable.

A suitably diluted alkali metal chlorite feed solution, preferably sodium or potassium, is fed into anolyte compartment 12 through anode solution entry port 20 and anolyte solution distributor channels 12 at a suitable flowrate to allow for the electrochemical conversion of the chlorite ion to chlorine dioxide by the flexible and compressible porous, high oxygen overvoltage, high surface area anode 14. The electrical current is conducted to anode 14 by the high oxygen overvoltage anode backplate or current distributor 13 which has one or more metallic anode conductor posts 35 to conduct the DC electrical power from a DC power supply (not shown). Fittings 36 are used to seal against conductor posts 35 to prevent solution leakage from the cell 10. Current splitter wire 39 and anode conductor post nuts 38 are used to distribute the electrical current to the anode distributor 13. The chlorine dioxide solution product exits through anode product distributor channels 24 and anode exit ports 22.

Softened or deionized water or other suitable aqueous solution flows through cathode solution entry port 28 and catholyte distributor channels 29 (only one of which is shown in FIG. 1) into the catholyte compartment 18 at an appropriate flowrate to maintain a suitable operating concentration of alkali metal hydroxide. The alkali metal hydroxide is formed by alkali ions (not shown) passing from the anolyte compartment 12 through the cation permeable ion exchange membrane 15 into catholyte compartment 18 and by the electrical current applied at the cathode 19 to form the hydroxyl ions ($OH^-$) at the cathode surface. The cathodic reaction produces hydrogen gas, as well as the hydroxyl ions, from the electrolysis of water. The catholyte alkali metal hydroxide solution by-product and hydrogen gas (not shown) pass through cathode product distributor channels 31 into cathode exit ports 30 for removal from the cell 10 for further processing.

Electrolysis occurs in the cell 10 as the chlorite solution passes parallel to the membrane 15 through the anolyte compartment, causing the chlorine dioxide concentration to increase in the anolyte compartment 12 as the chlorite ion concentration decreases according to the following anodic reaction:

$$ClO_2^- \rightarrow e^- + ClO_2.$$

Alkali metal ions, for example, sodium, from the anolyte pass through the membrane 15. As the chlorite ion content of the anolyte decreases and the chlorine dioxide content increases, a portion of the chlorine dioxide can be oxidized, depending upon the PH, to chlorate at the anode according to the following undesirable reaction:

$$ClO_2+H_2O \rightarrow HClO_3+H^++e-.$$

This undesirable reaction can be avoided by maintaining a suitably acidic anolyte and, especially at higher pH's, by controlling the potential at the anode surface while providing mass transport of the chlorite ions from the bulk solution to the anode surface and the transport of chlorine dioxide away from the anode surface. This permits high chlorine dioxide yields to be obtained.

The gaskets 34 are preferably made of oxidation resistant rubber or plastic elastomer material. Suitable types of gaskets are those made from rubber type materials such as EPDM or that sold under the trade name Viton (R), and the like. Other suitable types of gasket materials include flexible closed foam types made from polyethylene or polypropylene which can be easily compressed to a thin layer to minimize distances between the membrane 15 and the anode 13 and cathode 19 structures.

Oxidation and high temperature resistant membranes 15 are preferred. Among these are the perfluorinated sulfonic acid type membranes such as DuPont NAFION® types 117, 417, 423, and the like, membranes from the assignee of U.S. Pat. No. 4,470,888, and other polytetrafluorethylene based membranes with sulfonic acid groupings such as those sold under the RAIPORE tradename by RAI Research Corporation. Other suitable types of membranes that are combinations of sulfonic acid/carboxylic acid moieties include those sold under the ACIPLEX tradename by the Asahi Chemical Company and those sold by the Asahi Glass Company under the FLEMION® tradename.

Optionally a thin protective non-conductive spacer material 27 shown in FIG. 2, such as a chemically resistant non-conductive plastic mesh or a conductive material like graphite felt, can be put between the membrane 15 and the surface of the anode 14 to permit the use of expanded metal anodes. A thin plastic spacer 23 can also be used between the cathode 19 and the membrane 15. This spacer 23 in the catholyte compartment 18 should also be a non-conductive plastic with large holes for ease of disengagement of the hydrogen gas from the catholyte compartment 18. It should be noted that FIG. 2 shows the cell 10 in cross-section, but before the cell 10 has been fully compressed in its assembled state. In this assembled state the space or gap shown in FIG. 2 between plastic spacer 23, spacer material 27 and the membrane 15 does not exist as the gaskets 34 are compressed down. The cell 10 preferably is operated with the membrane 15 in contact with the plastic spacer 23 and the spacer material 27 when they are employed and with the membrane 15 in contact with the cathode electrode 19 and the anode electrode 14 when they are not employed.

The preferred anolyte chlorite feed solution is sodium chlorite with a feed concentration of about 0.1 to about 30 gpl for one-pass through flow operation. Should it be desired to operate the cell 10 in a recirculation system, very strong sodium chlorite solutions can be used which will result in a low conversion rate of chlorite to chlorine dioxide per pass of anolyte through the anode 14. Additives in the form of salts can be used in the chlorite feed solution, such as alkali metal phosphates, sulfates, chlorides and the like, to increase the conversion efficiency to chlorine dioxide, reduce operating voltage, provide pH buffering of the product solution, or add to the stability of the chlorine dioxide solution in storage.

Figure 3:
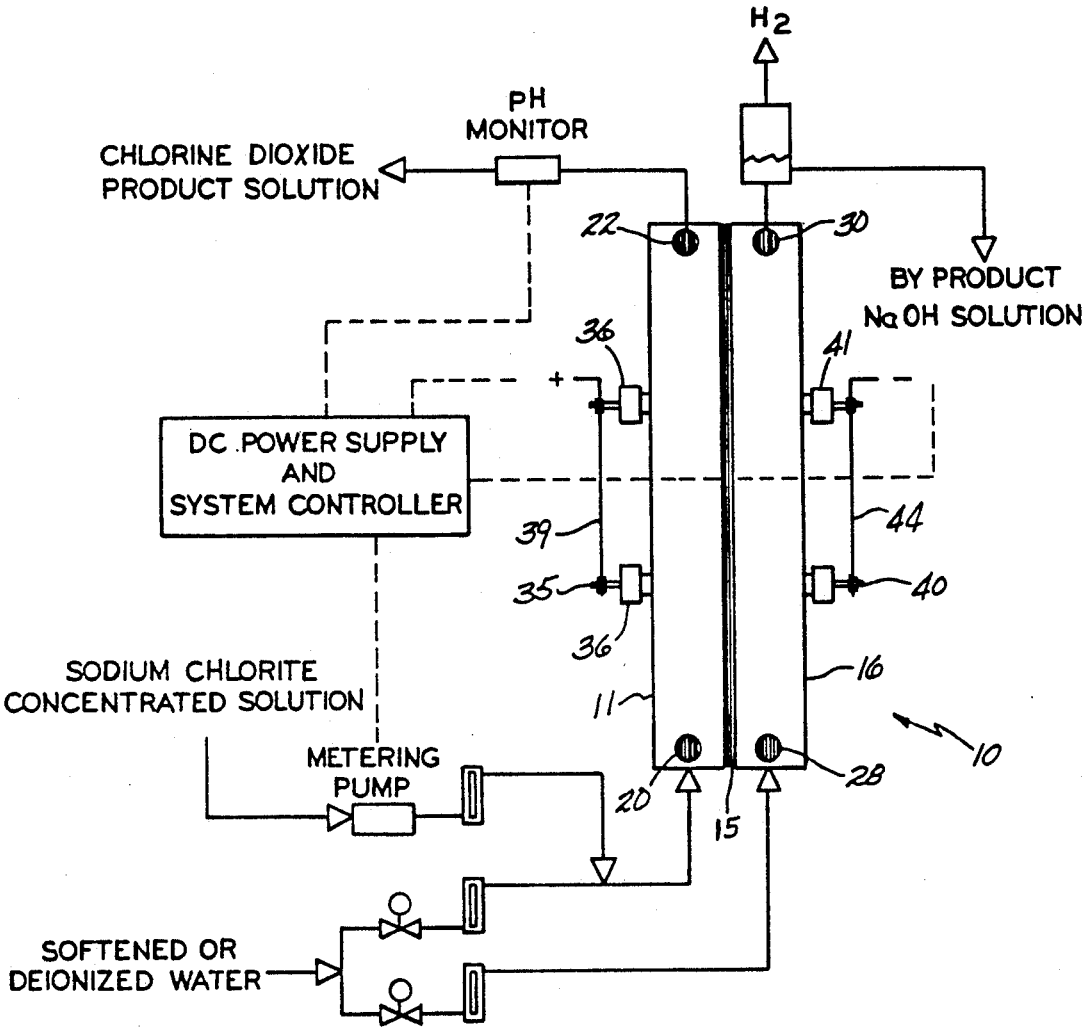
FIG. 3 is a diagrammatic illustration of a system employing the chlorine dioxide generating electrolytic cell.

In operation, the cell 10 in a system such as that shown in FIG. 3 operates with the electrolytes in a temperature range of from about 5 degrees Centigrade to about 50 degrees Centigrade, with a preferred operating temperature range of about 10 degrees Centigrade to about 30 degrees Centigrade. The anolyte feed has previously been identified as a sodium chlorite solution which is diluted by mixing with softened or deionized water to the desired concentration. The catholyte is either deionized water or softened water, depending on what is readily available and if the by-product sodium hydroxide has a potential end use for other areas of the installation, such as for pH control.

The cell 10 uses an operating current density of from about 0.01 KA/m2 to about 10 KA/m2, with a more preferred range of about 0.05 KA/m2 to about 3 KA/m2. The constant operating cell voltage and electrical resistance of the anolyte and catholyte solutions are limitations of the operating cell current density that must be traded off or balanced with current efficiency and the conversion yield of chlorite to chlorine dioxide. The cell operating voltage depends on the oxygen overvoltage of the anode materials used in the anode structures. The higher the oxygen overvoltage of the anode materials, the higher voltage at which the cell 10 can be operated and still maintain a high current efficiency and yield to chlorine dioxide. The typical operating voltage range is between about 2.0 to about 5.0 volts, with a preferred range of about 2.5 to about 4.0 volts.

Additionally the ratio of the total surface area of the anode to the superficial surface or projected area of the membrane impacts the current density at which the cell 10 can be operated and the total cell voltage. The higher that this particular ratio is, the greater is the maximum current density and the lower is the total cell voltage at which the cell can be operated.

The anolyte flow rate through the cell 10 and the residence time of the anolyte in the cell 10 are factors that affect the efficiency of the conversion of the chlorite to chlorine dioxide. There are optimum flow rates to achieve high efficiency conversion of chlorite to chlorine dioxide and to obtain a specific pH final product solution needed for the commercial applications for a single pass flow through system. The typical residence times for the single pass flow through system in the cell 10 are between about 0.1 to about 10 minutes, with a more preferred range of about 0.5 to about 4 minutes to achieve high conversion of chlorite to chlorine dioxide with high current efficiency. Very long residence times can increase chlorate formation as well as reduce the pH of the product solution to very low values (pH 2 or below) which may be detrimental to the anode structures.

The catholyte and by-product sodium hydroxide concentration should be about 0.1 to about 30 weight percent, with a preferred range of about 1 to about 10 weight percent. The optimum hydroxide concentration will depend on the membrane performance characteristics. The higher the caustic or sodium hydroxide concentration, the lower the calcium concentration or water hardness needed for long life operation of the membrane.

In order to exemplify the results achieved by the process of plating a valve metal substrate with an oxide forming precious metal, the following examples of platinum plating fine titanium fibers to be employed in the high surface area flow through anode of an electrochemical cell are provided without intent to limit the scope of the instant invention to the discussion therein. The specific percentage of the surface area of the valve metal substrate covered by the electrocatalytic precious metal can vary widely and still obtain an effective catalytic reaction when the resultant coated electrode is used in an electrolytic process. This percentage of coated surface area can vary from as little as about 10 percent to as much as about 95 percent, where the upper limit is normally determined by the cost of the expensive precious metal used as the coating material and the surface area of the electrode to be coated. More preferably the percentage of coated surface area can vary from as little as about 15 percent to as much as about 90 percent. Most preferably the percentage of coated surface area can vary from as little as about 25 percent to as much as about 90 percent.

EXAMPLE 1

One pound of fine titanium fiber specially prepared by a melt spin process by Ribbon Technology Corporation, Gahanna, Ohio was placed in a 5 gallon (19 liter) glass tank. The titanium fibers were in the form a ribbons with a thickness of about 0.002 inches (0.00508 cm), a width of about 0.004 inches (0.01016 cm) and individual fiber lengths of about 2 to about 8 inches (5.08 to 20.32 cm) in length. The glass tank with the one pound batch of fibers was placed on top of a hot plate for solution heating.

About 10 liters of a 1:1 volume ratio mix of distilled water to about 37% reagent grade hydrochloric acid was added to the tank so that the fibers were totally immersed in the solution. The solution was continually heated until sufficient amounts of hydrogen bubbles evolved from the titanium surfaces of the fibers and the solution began turning blue because of the formation of soluble titanium trichloride from the titanium that dissolved from the surfaces of the fibers. This occurred at about 50° C. after about 20 minutes of heating. The acid etching was continued for another 20 minutes until the evolution of hydrogen was uniform from the fiber surfaces and the titanium fiber surfaces had turned slightly gray upon visual inspection. The fiber batch was then removed from the acid bath and quickly rinsed in deionized water.

A two part platinum plating solution was prepared from about 339 ml of a chloroplatinic acid solution containing about 16.95 gm (0.545 troy oz. or 0.08688 gm-moles) of platinum metal. The chloroplatinic acid solution was diluted to about 3 liters with deionized water and pH adjusted with dilute 5% sodium hydroxide to a pH value of about 2.0. The second part of the plating solution containing the platinum reducing agent was prepared by dissolving about 1000 gm (2.205 lb or 14.38 gm-moles) of reagent grade hydrazine dihydrochloride crystal in about 5 liters of deionized water. Both solutions were mixed with an additional 2 liters of deionized water to obtain about 10 liters of an orange-yellow colored electroless platinum plating solution. The solution contained about 1.70 gm/l of platinum metal and had a 165:1 molar ratio of reducing agent to platinum.

The rinsed fibers were then put into another glass tank with an external hot plate and immersed into the 10 liter electroless platinum plating solution, initially having an ambient temperature of about 25° C. and then heated. Nitrogen gas bubbles were immediately evolved from the surface of the fibers upon addition to the electroless bath. This indicated the plating of platinum onto the surfaces of the fibers. The bubble evolution decreased to small amounts after about 30 minutes as the solution temperature slowly increased. The loss of the orange-yellow color to a water color in the plating solution is an indication of the extent of the completion of the platinum plating. Verification of the presence of residual platinum in the plating bath was done by taking samples of the plating solution and making the sample alkaline by the addition of 10% NaOH. A black precipitate indicated some residual platinum was left in the plating bath.

The plating solution with the fibers was heated to a temperature of about 100° C. There were still significant amounts of platinum in the plating solution at the end of 4 hours. The plating bath was kept at that temperature overnight for a total time of about 16 hours. At the end of 16 hours there was no soluble platinum left in the plating solution. The plating was therefore completed sometime in the time period of between 4 to 16 hours. The plated titanium fibers had a dull metallic luster. If a thin, continuous layer of platinum were deposited on the titanium fibers, the calculated coating thickness of the platinum was estimated to be about 0.13 microns.

Figure 4:
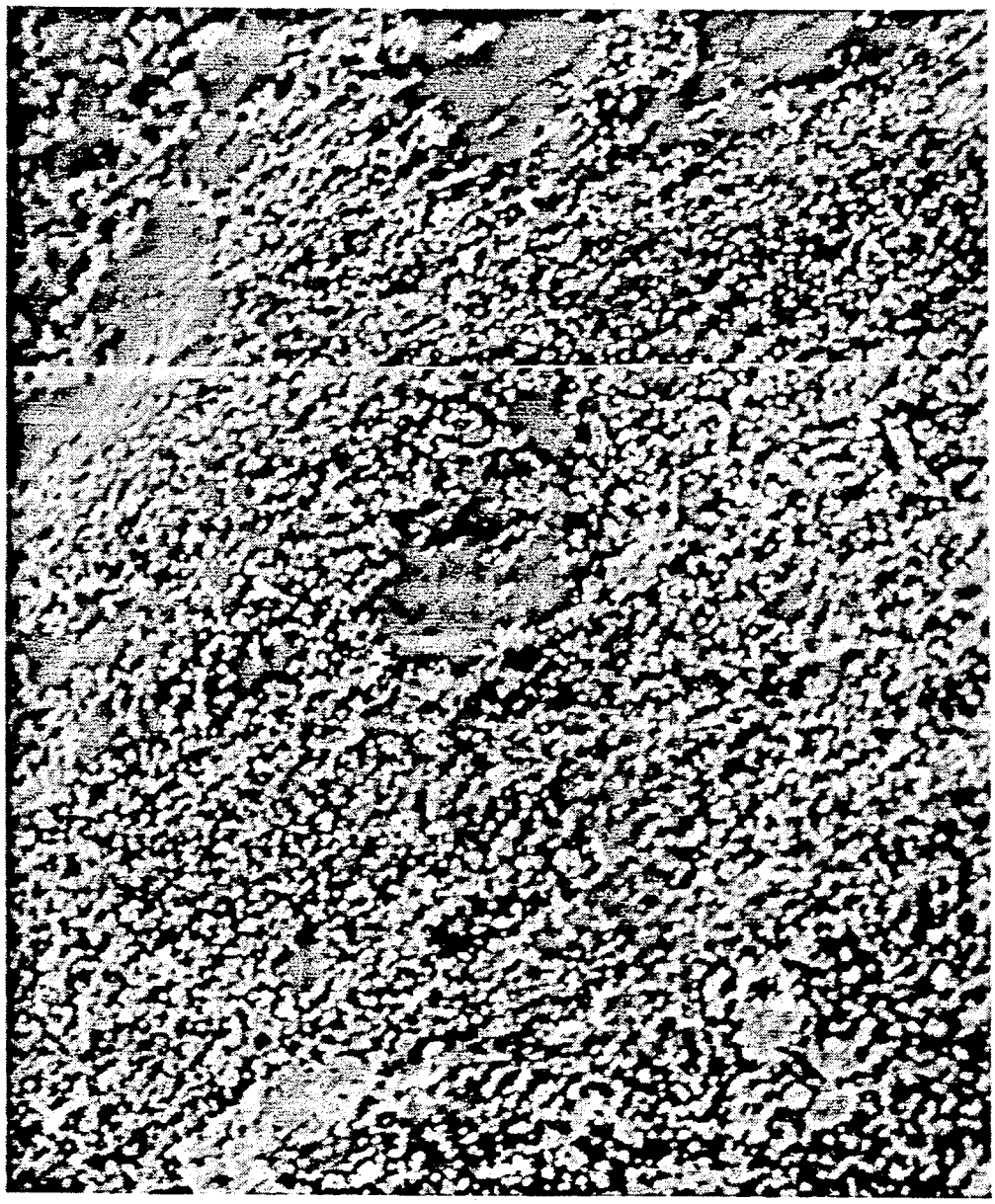
FIG. 4 is an electron photomicrograph of the electrocatalytic platinum coating of Example 1 at a magnification of 2000.

Scanning electron microscopy (SEM) examination of the plated titanium fibers showed a fairly smooth titanium surface base structure with a scattered surface coverage of approximately spherical shaped platinum grains having diameters in a size range of about 0.25 to about 0.75 microns. The actual surface was not the expected smooth, even platinum layer coated on the titanium. FIG. 4 is an electron photomicrograph (2000X magnification) that shows a representative example of the platinum grain crystal surface coating on the etched titanium fiber surfaces.

EXAMPLE 2

A second one pound batch of the titanium fiber lot was placed in a 5 gallon (19 liter) glass tank on top of a hot plate for solution heating. About 10 liters of a stronger 1:2 volume ratio of distilled water to about 37% reagent grade hydrochloric acid etchant mixture was added to the tank so that the fibers were totally immersed in the solution. The solution was continually heated until sufficient amounts of hydrogen bubbles evolved from the surfaces of the titanium fibers and the solution began turning a deep blue color from the soluble titanium trichloride that dissolved from the surfaces of the fibers. This occurred at about 50° C. after about 10 minutes. The acid etching was continued for about another 20 minutes until the surfaces of the titanium fibers had turned gray upon visual inspection. The fiber batch was then removed from the acid bath and quickly rinsed in deionized water.

The same composition two part 10 liter volume platinum plating solution containing about 16.95 gm (0.545 troy oz.) of platinum metal and about 1000 gm of hydrazine dihydrochloride was prepared exactly as in Example 1, except that the plating solution was preheated to about 50° C. The deionized water rinsed titanium fibers were then put into the preheated 10 liters of the electroless platinum plating solution with heat applied. Nitrogen gas bubbles were immediately evolved from the surface of the fibers upon addition to the electroless bath, indicating the plating of platinum onto the surfaces of the fibers. The bubble evolution decreased to small amounts after about 30 minutes as the solution temperature slowly increased. The plating solution with the fibers was heated to a temperature of about 100° C. and kept at that temperature overnight for a total time of about 18 hours. There was no soluble platinum found in the plating solution at the end of the 18 hours. The plating was complete sometime in the time period of between 5 to 18 hours. The plated titanium fibers had a dull, medium gray color.

Figure 5:
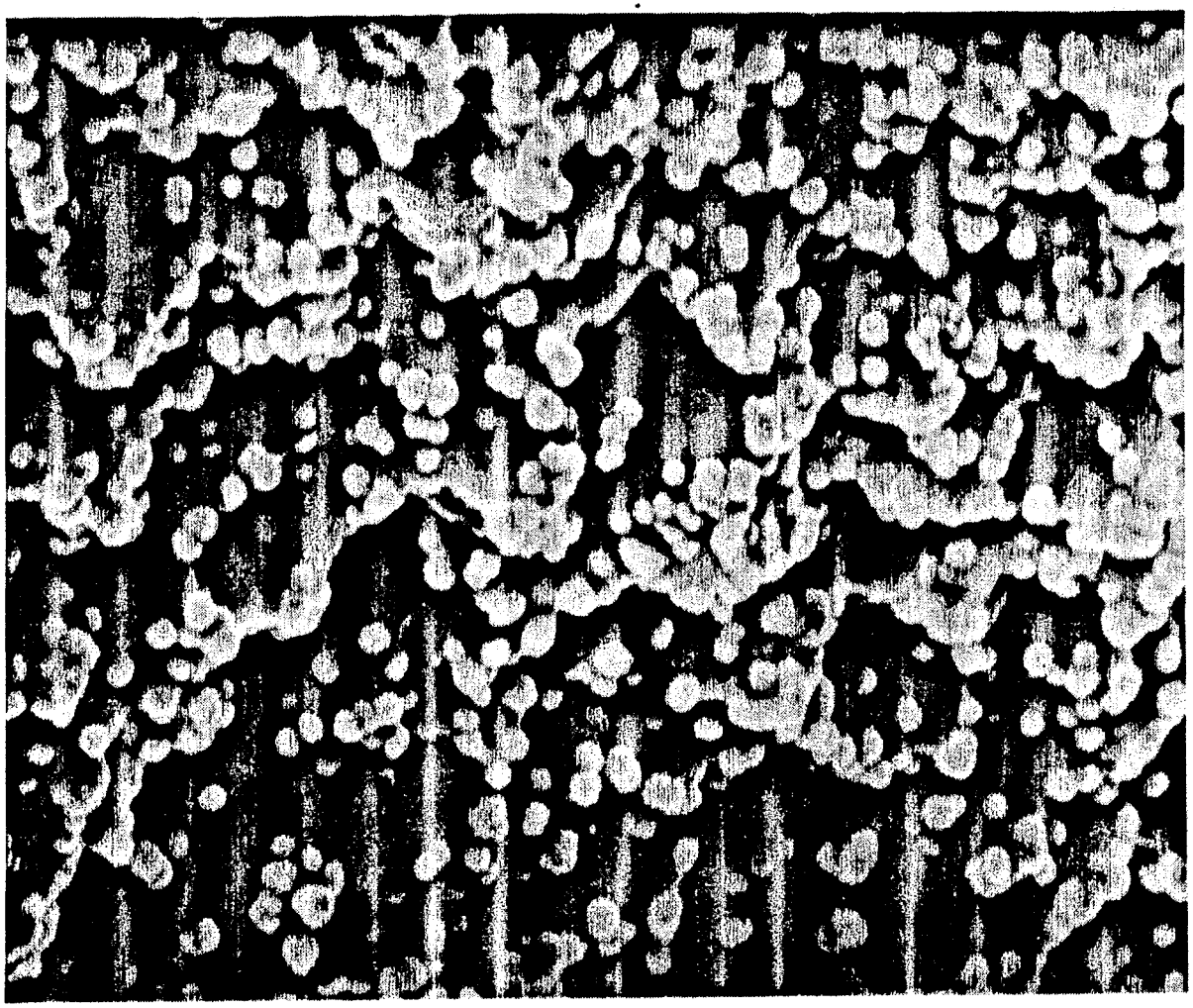
FIG. 5 is an electron photomicrograph of the electrocatalytic platinum coating of Example 2 at a magnification of 8000.

SEM examination of the plated titanium fibers showed a roughened, honeycomb-type titanium surface base structure with the inside and outside honeycomb surfaces covered with a scattering of approximately spherically shaped platinum grains having diameters in a size range of about 0.50 to about 0.75 microns. FIG. 5 shows an electrophotomicrograph (8000X magnification) with a representative view of the platinum grain crystal surface coating on the surfaces of the etched titanium fibers. The honeycomb titanium etched structure was estimated to have an etch depth of about 1 to about 2 microns and a honeycomb diameter of about 1 to about 4 microns.

EXAMPLE 3

The same 10 liters of the same 1:2 volume ratio of distilled water to about 37% reagent grade hydrochloric acid etchant mixture in a 19 liter glass tank used in Example 2 was used to etch a third one pound batch of the titanium fiber lot. The etching solution was already hot at about 60° C. The titanium fibers began evolving hydrogen in about 10 minutes. The acid etching of the fibers was continued until the surfaces of the titanium fibers had turned gray upon visual inspection. The fiber batch was then removed from the acid bath and quickly rinsed in deionized water.

The same composition two part 10 liter volume platinum plating solution containing about 16.95 gm (0.545 troy oz.) of platinum metal and about 1000 gm of hydrazine dihydrochloride was prepared exactly as in Example 2, except that the plating solution was preheated to about 70° C. The deionized water rinsed titanium fibers were then put into the preheated 10 liters of the electroless platinum plating solution with heat applied. Nitrogen gas bubbles were immediately evolved from the surface of the fibers upon addition to the electroless bath, indicating the plating of platinum onto the surfaces of the fibers. The bubble evolution decreased to small amounts after about 30 minutes as the solution temperature slowly increased. The plating solution with the fibers was heated to a temperature of about 100° C. and kept at that temperature overnight for a total time of about 16 hours. There was no soluble platinum in the bath at the end of 16 hours. The plating was completed sometime in the time period of between 3 to 16 hours. The plated titanium fibers had a dull, medium gray color.

SEM examination of the plated titanium fibers showed a similar roughened, honeycomb-type titanium surface base structure as in Example 2 with the inside and outside honeycomb surfaces covered with a scattering of approximately spherically shaped platinum grains, but with the grains having diameters in a size range of about 0.50 to about 0.70 microns.

EXAMPLE 4

The three one pound lots of platinum plated titanium fiber prepared in Examples 1–3 were hand laid into a metallic felt and used as flow-through anode structure in an electrochemical cell to oxidize dilute aqueous solutions of sodium chlorite to chlorine-free chlorine dioxide solutions. The dilute aqueous solutions of sodium chlorite contained conductive salts.

A two compartment electrochemical cell was constructed similar to that shown in FIG. 1 from about 1.0 inch (2.54 cm) thick type 1 PVC (polyvinyl chloride). The outside dimensions of both the anolyte and catholyte compartments were about 42 inches (1.067 meters) by about 42 inches with internal machined dimensions of about 39 inches (0.9906 meters) wide by about 39 inches long and a recess depth of about 0.375 inches (0.9525 cm) for the anode compartment and about 0.185 inches (0.470 cm) for the cathode compartment.

The anode compartment was fitted with about a ¼" (0.635 cm) thick by about 38.875 inch (0.987 meters) wide by about 38.875 inch (0.987 meters) long ASTM grade 2 titanium plate current distributor with nine ¾" (1.905 cm) titanium conductor posts welded to the backside mounted on 13 inch centers and routed through matched holes drilled into the anolyte PVC frame. The titanium anode plate was glued or sealed into the inside anode recess using two layers of about a 0.005 inch (0.0127 cm) loose open weave fiberglass mat for adhesive support and a silicone based sealant/adhesive to prevent any solution flow behind the anode. Polypropylene ¾ inch NPT (national pipe thread) to ¾ inch tubing fittings were used to seal the titanium conductor posts on the backside of the PVC anode compartment.

The titanium surface was then abraded with rough sandpaper and chemically etched with concentrated hydrochloric acid for about 10 to about 15 minutes until the surface was grayish in color and then rinsed with deionized water. The top of the titanium current distributor plate surface was then immediately brush electroplated to obtain about a 1.19 micron (46.9 microinch) thick platinum coating using 500 ml of chloroplatinic acid solution containing about 25 gm (0.804 troy oz.) of platinum metal equivalent.

The three pounds of platinum plated titanium felt was then placed into the approximately ⅛ inch (0.3175 cm) recess above the mounted platinum plated anode current distribution plate. The metallic felt, when finally compressed during cell assembly, had a calculated specific surface area of about 57 $cm^2/cm^3$ with a fill density of about 9.7% in the recessed area.

The PVC catholyte compartment was fitted with a 0.060 inch (0.1524 cm) thick by 38.875 inches (0.987 meter) wide by 38.875 inches (0.987 meter) long perforated plate made of type 316L stainless steel having ⅛ inch (0.3175 cm) holes set on a ⅛ inch stagger with about a 41% open area. The perforated plate had nine ¾ inch (1.905 cm) 316 stainless steel conductor posts welded to its backside, mounted on 13 inch centers and routed through matched holes drilled into the catholyte PVC frame. Two layers of about 1/16 inch (0.1588 cm) thick polypropylene mesh with about ¼ inch (0.635 cm) square holes were mounted under the stainless steel cathode to position the cathode approximately flush with the surface of the compartment and to provide for hydrogen gas and sodium hydroxide liquid disengagement from the compartment. Polypropylene ¾ inch NPT to ¾ inch tubing fittings were used to seal the 316 stainless conductor posts on the backside of the PVC anode compartment.

The electrochemical cell assembly was completed using about a 0.040 inch (0.1016 cm) thick polytetrafluorethylene compressible GORE-TEX® gasket tape, available from W. L. Gore & Associates, on the sealing surfaces of the cell frames. A DuPont NAFION® 417 polytetrafluorethylene fiber reinforced perfluorinated sulfonic acid cation permeable type membrane was then mounted between the anolyte and catholyte compartments. Two approximately 1.0 inch (2.54 cm) thick steel end plates with appropriate holes for the conductor posts were then used to compress the cell unit using ⅞ inch (2.223 cm) threaded steel tie rods, nuts, and spring washers.

The following test run performance data was obtained with the above electrochemical cell unit assembly as given in Table 1 below. The concentrated cell feed was prepared by mixing about a 26 percent by weight sodium chloride and about a 25 percent by weight sodium chlorite solution in a 1:1 weight ratio. The concentrated formulated feed solution was then diluted with softened water to obtain a dilute feed solution concentration of about 9.61 gpl as $NaClO_2$. The diluted feed was metered into the cell anolyte compartment at the flowrates listed in Table 1. The applied amperage was adjusted as given to obtain the desired output chlorine dioxide solution product pH of about 3.0 at each flowrate. As can be seen, at a feed flowrate 0.75 liters per minute, the chlorite to chlorine dioxide conversion was about 96.4%. As the flowrate was increased to about 2.5 liters per minute, the chlorite to chlorine dioxide conversion percentage decreased to about 86.8% at the indicated solution pH values and amperage settings. Table 1 also lists the chlorine dioxide production rate at each flowrate as well as the electrical operating cost in $/DCKWH per pound of chlorine dioxide produced.

TABLE I

ONE SQUARE METER ELECTROCHEMICAL CHLORINE DIOXIDE GENERATOR
CELL TRIAL PERFORMANCE RESULTS
ANODE TYPE: 4 Mil DIAMETER PLATINUM PLATED TITANIUM FIBER FELT

| FORMULATED SODIUM CHLORITE FEED FLOWRATE 1/Min | CELL AMPERAGE IN AMPS | CELL VOLTAGE IN VOLTS | C102 PRODUCT SOLUTION pH | C102 PRODUCT SOLUTION gpl C102 | CHLORITE TO C102 CONVERSION % EFFICIENCY | C102 PRODUCTION RATE-Lb/Hr | OPERATING COST $/Lb C102 |
|---|---|---|---|---|---|---|---|
| 0.75 | 141 | 2.57 | 3.05 | 6.91 | 96.4 | 0.69 | $0.029 |
| 1.00 | 187 | 2.68 | 3.08 | 6.86 | 95.7 | 0.91 | $0.030 |
| 1.25 | 234 | 2.81 | 3.01 | 6.81 | 95.0 | 1.13 | $0.032 |
| 1.50 | 280 | 2.90 | 3.08 | 6.60 | 92.4 | 1.31 | $0.034 |
| 2.00 | 362 | 3.10 | 3.06 | 6.44 | 89.8 | 1.69 | $0.037 |
| 2.50 | 452 | 3.22 | 3.03 | 6.22 | 86.8 | 2.06 | $0.039 |

Notes:
1. Test conducted with 9.61 gpl concentration NaClo2 in formulated feed. Maximum theoretical C102 concentration = 7.17 gpl C102
2. Power cost at $0.055/DCKWH

EXAMPLE 5

An electrochemical cell was constructed similar to that of FIG. 1 consisting of two compartments machined from about 1 inch thick PVC (polyvinyl chloride). The outside dimensions of both the anolyte and catholyte compartments were about 5 inches (12.7 cm) by about 14 inches (35.56 cm) with machined internal dimensions of about 3 inches (7.62 cm) by about 12 inches (30.48 cm) by about ⅛ inch (0.3175 cm) deep.

The anolyte compartment was fitted with a 1/16 inch (0.1588 cm) thick by about 3 inch (7.62 cm) by about 12 inch (30.48 cm) titanium plate having a 0.25 inch (0.635 cm) diameter titanium conductor post on the back side and a 100 microinch (2.54 micron) platinum electroplated surface on the front side. The titanium anode plate was glued or sealed into the inside anode recess with a silicone based adhesive to prevent any solution flow behind the anode. A platinum plated high surface area metallic felt prepared as described below was then placed into the 1/16 inch (0.1588 cm) recess above the mounted anode plate.

The high surface area metallic felt was prepared from about 8 grams of a 12 micron (0.00047 inch) diameter multifilament titanium tow fiber obtained from Bekaert Corporation which was hand pulled and laid to form a metallic felt with long fibers (about 0.5 to about 6 inches or about 1.27 to about 15.24 cm) into about a 3 inch (7.62 cm) wide by about 12 inch (30.48 cm) long physical form similar to glass wool. The metallic fibers in the prepared felt were acid etched with about 30 percent by weight hot concentrated HCl (about 50° C.) for about 15 minutes until there was sufficient hydrogen bubble release from the titanium fibers and the fiber surfaces turned a light gray color. Care was taken to not etch the fibers excessively because of their small diameter size. The titanium felt was then quickly rinsed in deionized water and folded into a one liter beaker on top of a hot plate/magnetic stirrer. Then about 800 ml of a prepared two part electroless platinum plating solution was immediately poured into the beaker.

The plating solution was prepared by diluting about 30 ml of a chloroplatinic acid solution containing about 5 grams of platinum metal per 100 ml solution into a 200 ml volume with deionized water for a total of about 1.5 grams (0.02563 gm-moles) of platinum metal. The solution was then pH adjusted with about 5 percent by weight NaOH to obtain a pH of about 2.0. The second part of the two part plating solution is a reducing agent solution that was prepared by dissolving about 50 grams (0.719 gm-moles) of hydrazine dihydrochloride in crystal in about 600 ml of deionized water. These two solutions were then mixed to obtain the electroless platinum plating solution containing about a 28:1 molar ratio of reducing agent to platinum metal.

The ambient temperature (about 25° C.) platinum plating solution with the etched titanium fibers was then heated and the solution stirred using a magnetic stirring bar in an open area below the felt. Nitrogen bubbles were released immediately on contact with the solution. The plating solution temperature was quickly heated to about 60° to about 70° C. in about 20 minutes. The plating solution became a clear, water color in about one hour. An alkaline precipitation test showed no residual platinum in the plating solution. The platinum plated felt mat was then rinsed in deionized water, air dried, and then mounted as described above into the 1/16 inch anode recess area.

The thickness of the platinum film coating deposited on the fibers was estimated to be about 0.16 microns from the about 1.5 grams of platinum metal equivalent deposited in the plating process. The final felt structure had a calculated specific surface area of about 160 $cm^2/cm^3$ with a fill density of about 4.8% in the recess area. Examination of the platinum plated titanium fiber surfaces with a Scanning Electron Microscope (SEM) showed spherical platinum crystallites deposited on the surfaces and in the acid etched grooves of the titanium fibers. The diameter of the spherical platinum crystallites appeared to be about a 0.3 to about 0.6 microns. Surface coverage of the fibers with the platinum crystallite spheres was estimated to be between about 40 to about 60 percent of the individual fiber surfaces. The depth of the etched grooves in the titanium fibers was estimated to range between about 0.5 to about 2.5 microns, depending on individual fiber etching rates.

The catholyte compartment was fitted with about a 1/16 inch (0.1588 cm) thick by about 3 inch (7.62 cm) by about 12 inch (30.48 cm) type 316L stainless steel perforated plate having about a 0.25 inch (0.635 cm) diameter 316L stainless conductor post on the back side. The cathode plate was mounted into the inside anode recess with about a 1/16 inch (0.1588 cm) thick expanded polytetrafluorethylene mesh behind the cathode plate into order to have the cathode surface flush with the inside surface of the anolyte compartment.

The electrochemical cell assembly was completed using about 0.020 inch (0.0508 cm) thickness polytetrafluorethylene compressible GORE-TEX ® gasket tape, available from W. L. Gore & Associates, on the sealing surfaces of the cell frames. A DuPont NAFION ® 117 nonreinforced perfluorinated sulfonic acid cation permeable type membrane was then mounted between the anolyte and catholyte compartments.

The following test runs were conducted with the assembled electrochemical cell unit. In this set of tests, about a 25 percent by weight sodium chlorite concentrated feed containing about 4 percent by weight NaCl with a $NaCl:NaClO_2$ weight ratio of about 0.16:1 was diluted in deionized water to obtain about a 9.90 gpl concentration of sodium chlorite containing about 1.6 gpl NaCl. The base diluted feed was used as is, or with the indicated addition of NaCl or $Na_2SO_4$ to the feed as indicated to demonstrate the enhanced chlorite to chlorine dioxide conversion performance of the electrochemical cell with the added conductive salt. The combined total conductive salts to NaClO2 weight ratios in these tests were equal to about 0.57:1 for both the NaCl and $Na_2SO_4$ feed addition runs.

The various chlorite feeds were metered into the anolyte compartment of the cell at a mass feedrate of about 21 grams/minute. A softened water flow of 10 ml/minute was metered into the catholyte compartment to produce dilute by-product NaOH. The applied cell amperage was varied and the cell voltage, output pH, and chlorine dioxide concentration were monitored. The chlorine dioxide solution concentration was monitored with a special design spectrophotometer utilizing a 460 nanometer wavelength that was calibrated for use in this high chlorine dioxide solution concentration range. The chlorine dioxide concentrations were also periodically checked by iodiometric titration. Several of the product solution samples were analyzed for chlorite and chlorate ion residuals after the chlorine dioxide was air sparged from the solution product.

The results are listed in Table II below.

TABLE I

DIRECT ELECTROCHEMICAL CHLORINE DIOXIDE GENERATOR EXPERIMENTAL TEST RUNS
Test Cell: 12 Micron Pt Plated Titanium Felt Anode
Effect of Added Salts To Chlorite Feed Solution On Cell Performance

| FEED gpl | FLOWRATE gm/min | CELL VOLTS | CELL AMPS | pH | C102 gpl | CONVERSION % | RESIDUALS IN CONCENTRATE PRODUCT SOLUTION C102-gpl | C103-gpl |
|---|---|---|---|---|---|---|---|---|
| NO ADDITIONAL SALTS ADDED TO BASE FEED: | | | | | | | | |
| 9.90 | 21.00 | 2.25 | 1.74 | 8.55 | 3.91 | 52.96 | | |
| 9.90 | 21.00 | 2.36 | 2.27 | 7.88 | 5.01 | 67.85 | | |
| 9.90 | 21.00 | 2.44 | 2.62 | 6.94 | 5.68 | 76.93 | | |
| 9.90 | 21.00 | 2.62 | 3.18 | 6.64 | 6.39 | 86.54 | | |
| 9.90 | 21.00 | 2.97 | 3.59 | 2.35 | 6.42 | 86.95 | | |
| 9.90 | 21.00 | 3.10 | 4.24 | 2.08 | 5.87 | 79.50 | | |
| 4 gpl NaCl ADDED TO BASE FEED: | | | | | | | | |
| 9.90 | 21.00 | 2.20 | 1.74 | 8.39 | 4.09 | 55.39 | | |
| 9.90 | 21.00 | 2.28 | 2.24 | 7.45 | 5.35 | 72.46 | | |
| 9.90 | 21.00 | 2.34 | 2.57 | 7.26 | 5.81 | 78.69 | | |
| 9.90 | 21.00 | 2.44 | 3.10 | 6.37 | 6.77 | 91.69 | 0.84 | 0.65 |
| 9.90 | 21.00 | 2.51 | 3.54 | 4.72 | 7.26 | 98.33 | 0.24 | 0.83 |
| 9.90 | 21.00 | 2.83 | 4.09 | 2.04 | 7.02 | 95.08 | | |
| 9.90 | 21.00 | 2.94 | 4.58 | 1.67 | 6.44 | 87.22 | | |
| 9.90 | 21.00 | 3.08 | 5.43 | 1.41 | 5.09 | 68.94 | | |
| 4 gpl Na2SO4 ADDED TO BASE FEED: | | | | | | | | |
| 9.90 | 21.00 | 2.29 | 2.09 | 8.57 | 4.51 | 61.08 | | |
| 9.90 | 21.00 | 2.37 | 2.58 | 7.45 | 5.55 | 75.17 | | |
| 9.90 | 21.00 | 2.50 | 3.17 | 6.50 | 6.65 | 90.07 | | |
| 9.90 | 21.00 | 2.75 | 3.62 | 2.62 | 7.21 | 97.65 | 0.00 | 1.18 |
| 9.90 | 21.00 | 2.91 | 4.08 | 1.99 | 6.59 | 89.25 | | |
| 9.90 | 21.00 | 3.04 | 4.58 | 1.63 | 5.46 | 73.95 | | |

EXAMPLE 6

The same electrochemical cell as in example 5 was used to evaluate the platinum plated titanium fibers made as described below.

About 20 grams of a 12 micron (0.00047 inch) diameter single length multifilament titanium tow fiber (obtained from Bekaert Corporation) containing about 500 filaments was cut from a large continuous spool. The tow fiber was then hot acid etched in about 20 percent by weight HCl at about 50° C. in a 1000 ml beaker. The beaker was placed on a hot plate for about 15 minutes until the hydrogen gas bubble evolution from the fibers was uniform and the fibers turned a light gray color. Care was taken to not etch the fibers excessively because of their small diameter size. The etched titanium tow fiber was then quickly rinsed in deionized water and placed into a premixed about 800 ml volume of platinum plating solution in a one liter beaker on top of a hot plate/magnetic stirrer. The premixed platinum plating solution contained about 60 ml of a chloroplatinic acid solution containing about 5 grams of platinum per 100 ml for a total of about 3.0 grams (0.05126 gm-moles) of platinum metal and about 20 grams (0.2876 gm-moles) of hydrazine dihydrochloride crystal. This solution had a ratio of reducing agent to platinum of about 5.6:1.

The nitrogen bubble evolution and platinum solution color change increased dramatically at a temperature of about 55° to about 60° C. The plating solution turned from yellow-orange to colorless in less than 15 minutes. No residual platinum was noted in the plating solution with the hydroxide addition test. The platinum plated titanium tow fiber was then washed with deionized water and then air dried.

Figure 6:
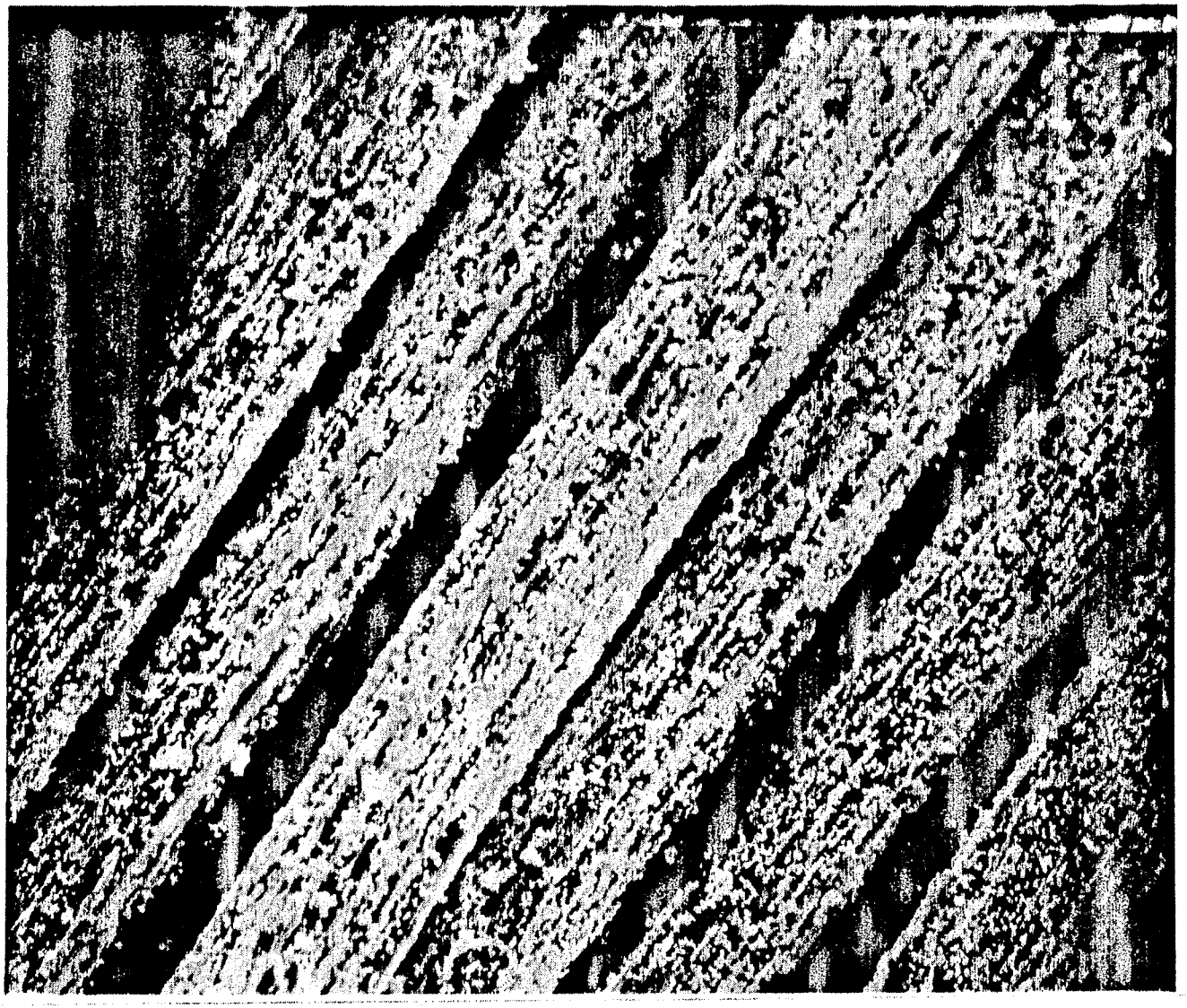
FIG. 6 is an electron photomicrograph of the electrocatalytic platinum coating of Example 6 at a magnification of 1600.
Figure 7:
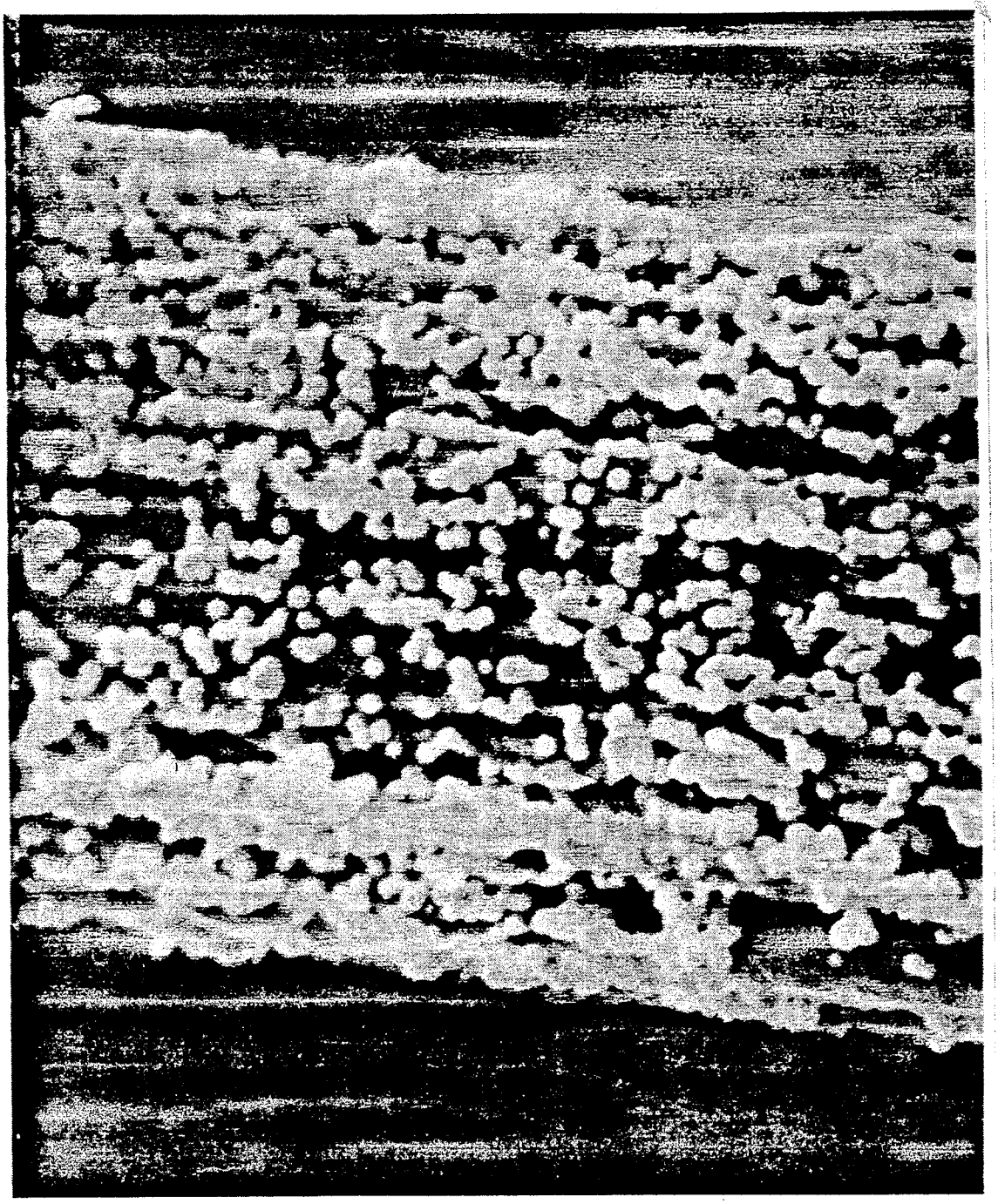
FIG. 7 is an electron photomicrograph of the electrocatalytic platinum coating of Example 6 at a magnification of 8000.

SEM examination of the platinum plated titanium fiber surfaces showed about 0.3–0.5 micron diameter spherical platinum crystallites deposited on the surfaces and in the acid etched grooves of the titanium fibers. Surface coverage of the fibers with the platinum crystallite spheres was estimated to be between about 60 to about 80 percent of the surfaces of the individual fibers. The depth of the etched grooves in the titanium fibers was estimated to range between about 0.5 to about 1.5 microns depending on individual fiber etching rates. FIG. 6 shows an electron photomicrograph (1600X magnification) of a representative example of the platinum grain crystal surface coating on the surfaces of the titanium fibers showing the generally spherically shaped geometric grain structure, while FIG. 7 shows an enlargement of the fibers at about 8000X magnification.

About 10 grams of the tow fiber was then cut into 12 inch lengths which were pulled apart by hand and laid to form a metallic felt about 3 inches (7.62 cm) wide by about 12 inches (30.48 cm) long. The platinum plated felt mat was then mounted as described above in Example 5 into the 1/16 inch anode recess area. The cell chlorite to chlorine dioxide conversion efficiency performance was similar to that of Example 5.

EXAMPLE 7

The same plating procedure was done as in Example 6 except that a higher concentration of platinum was used.

About 20 grams of a 12 micron (0.00047 inch) diameter single length multifilament titanium tow fiber (obtained from Bekaert Corporation) containing about 500 filaments was cut off a large continuous spool. The tow fiber was then hot acid etched in 20 percent by weight HCl at a temperature of about 50° C. in a 1000 ml beaker. The beaker was placed on a hot plate for about 15 minutes until the hydrogen gas bubble evolution from the fibers was uniform and the fibers turned a light gray color. Care was taken to not etch the fibers excessively because of their small diameter size. The etched titanium tow fiber was then quickly rinsed in deionized water and placed into about 800 ml volume of a premixed platinum plating solution in a one liter beaker on top of a hot plate/magnetic stirrer. The premixed platinum plating solution contained about 80 ml of a chloroplatinic acid solution containing about 5 grams of platinum per 100 ml for a total of about 4.0 grams (0.0683 gm-moles) of platinum metal and about 30 grams (0.4314 gm-moles) of hydrazine dihydrochloride crystal. This solution had a ratio of reducing agent to platinum of about 6.3:1.

The nitrogen bubble evolution and platinum solution color change increased dramatically at a temperature of about 55° to about 60° C. The plating solution turned from yellow-orange to colorless in less than 15 minutes. No residual platinum was noted in the plating solution with the hydroxide addition test. The platinum plated titanium tow fiber was then washed with deionized water and then air dried.

Figure 8:
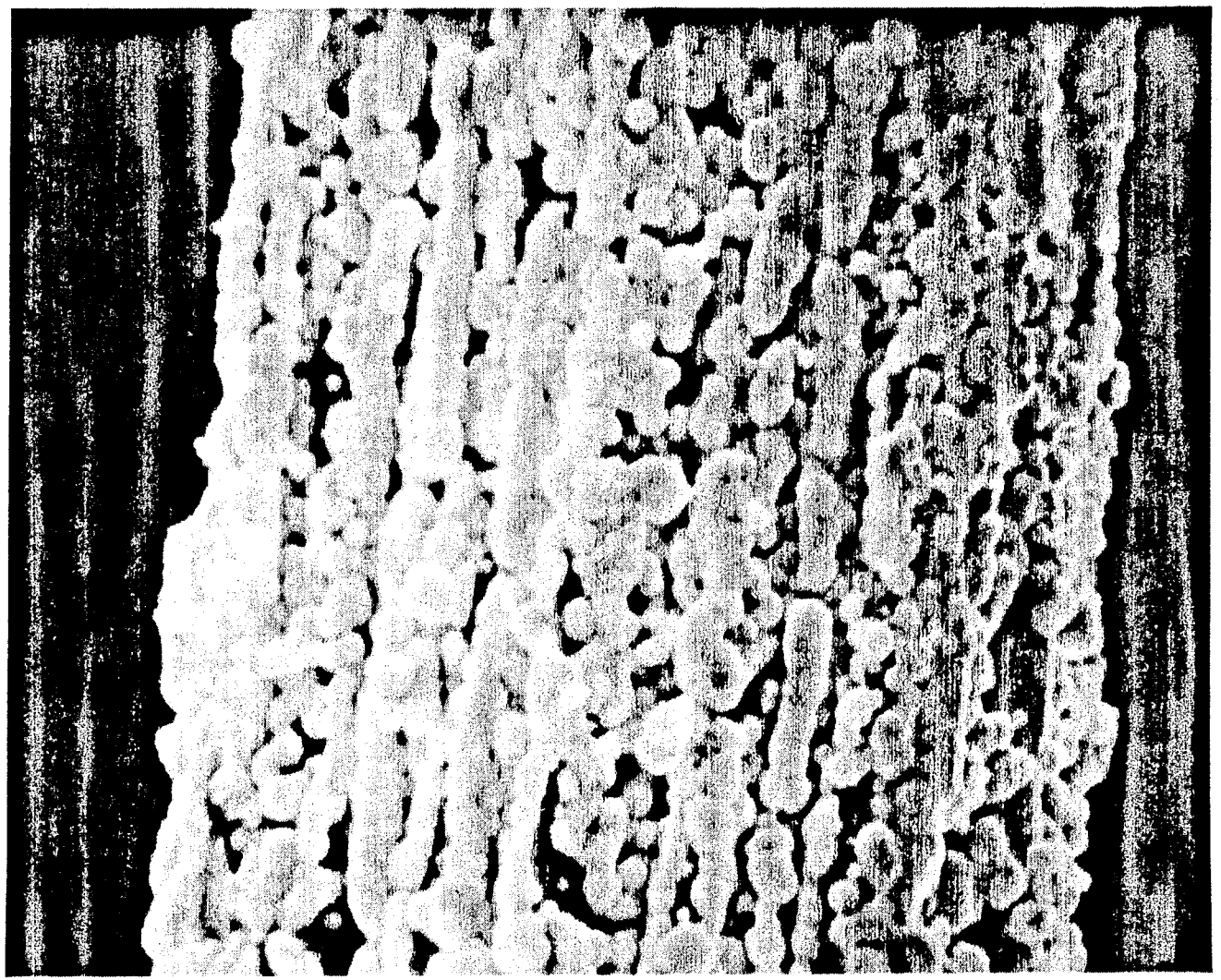
FIG. 8 is an electron photomicrograph of the electrocatalytic platinum coating of Example 7 at a magnification of 8000.

SEM examination of the platinum plated titanium fiber surfaces showed individual spherical platinum crystallites of about 0.4 to about 1.2 micron diameter that were both cocrystallized and attached to each other and onto the surfaces of the titanium fibers. Surface coverage of the fibers with the platinum crystallite spheres was estimated to be between about 75 to about 90 percent of the surfaces of the individual fibers. The depth of the etched grooves in the titanium fibers was estimated to range between about 0.5 to about 1.2 microns depending on individual fiber etching rates. FIG. 8 shows an electron photomicrograph (8000X magnification) of the crystallized platinum crystallites.

While the preferred structure in which the principles of the present invention have been incorporated as shown and described above, it is to be understood that the invention is not to be limited to the particular details thus presented, but, in fact, widely different means may be employed in the practice of the broader aspects of this invention.

For example, the cell 10 in which the improved electrode of the present invention is to be employed can also be arranged in a bipolar cell type arrangement using a solid plate type anode/cathode conductor or backplate. The anode/cathode combination could be a platinum clad layer on stainless steel, titanium, or niobium which is commercially available and is prepared by heat/pressure bonding. The platinum layer would be about 125 to about 250 microinches thick to reduce cost. In this design there would be separators/spacers between the membrane and cathode side to provide a hydrogen gas release zone.

The cell 10 could be operated in a system utilizing a single pass through design or in a system utilizing an anolyte recycle loop feed type operation where chlorine dioxide is the desired product to achieve optimum sodium chlorite conversion to chlorine dioxide in the anode compartment. Further, the electrolytic cell 10 can be operated to produce a high concentration chlorine dioxide solution containing up to about 14 gpl. The chlorine dioxide can then be sparged from the solution with air or nitrogen to transfer the chlorine-free chlorine dioxide in the gas phase to a process using it in, for example, municipal water treatment, gas sterilization systems, and fumigant systems. The gaseous chlorine dioxide from the solution can be easily removed down to a level of about 0.5 to about 1.0 gpl, for a removal efficiency of the chlorine dioxide from the solution on the order of about 90% or better for about 10 to about 14 gpl chlorine dioxide solutions.

Also, although the material of construction for the anolyte and catholyte compartments preferably is acrylic plastic, other suitable corrosion resistant materials are possible. Suitable corrosion resistant metals such as titanium, tantalum, niobium, zirconium or other valve metals, as well synthetic materials such as polyethylene, polyvinyl chloride, polyester resin or fiber reinforced resins could also be employed.

It should be understood that the catholyte can be any suitable aqueous solution, including alkali metal chlorides, and any appropriate acids such as hydrochloric, sulfuric, phosphoric, nitric, acetic or others. It is also possible to operate the cell 10 and the instant process with any appropriate separator, not merely a cation exchange membrane, as long as the separator is permeable to anions and cations to obtain the required electrical conductivity therethrough. Any microporous separator is acceptable and where an aqueous acid solution is used as the catholyte, the separator can be a diaphragm of the type used in diaphragm electrolytic cells. In this case some back migration of anions from the catholyte compartment to the anolyte compartment is expected and may be permissible, depending upon the application of the final product.

Where stronger chlorine dioxide product solutions are required, it is possible to obtain the desired product by using a higher concentration alkali metal chlorite feed solution of, for example, from about 50 to about 70 gpl in conjunction with an above atmospheric pressure in the cell 10. The higher pressure, from about 1.2 to about 5 atmospheres, is necessary to prevent the potentially explosive chlorine dioxide at concentrations of above about 50 gpl from coming out of solution into the explosive vapor phase.

Accordingly, the spirit and broad scope of the appended claims is intended to encompass all modifications, variations and all obvious changes in the process steps, details, materials, and arrangements of parts, which will occur to one of skill in the art upon a reading of the disclosure. All patent applications, patents and other publications cited herein are incorporated by reference in their entirety.

Having thus described the invention, what is claimed is:

1. A method of fabricating a porous, high surface area electrode used as an anode comprising the steps of:

(a) removing any oxide film coating from a valve metal substrate wherein said substrate has a porous, geometrically structured surface area;

(b) forming a plating solution comprising a solution of a precious metal salt and a reducing agent wherein the molar ratio of said reducing agent to said precious metal salt is from about 0.1:1 to about 500:1 and the pH of said plating solution is from about 0.025 to about 5;

(c) forming an electrocatalytic precious metal-plated electrode substrate having a porous, geometrically structured surface area by electrolessly plating said precious metal onto the oxide-free surfaces of said electrode substrate for a time to cover about 10 to about 95% of the surface area of said electrode substrate with said electrocatalytic precious metal; said electrocatalytic precious metal coating having grain crystals distributed on the surface of said substrate and said plated electrode substrate having a fill density of less than 60% and a surface area to volume ratio of greater than 10 $cm^2/cm^3$;

(d) removing said plated electrode substrate from said plating solution; and (e) subjecting said plated electrode to rinsing and drying.

2. The method of claim 1 wherein said valve metal is selected from the group consisting of titanium, niobium, zirconium, and tantalum.

3. The method of claim 2 wherein said valve metal is titanium.

4. The method of claim 1 wherein said plating solution comprises a mixture of a solution of chloroplatinic acid with a solution of a reducing agent selected from the group consisting of hypophosphites, formaldehyde, hydrazine, formic acid, borohydride, amine boranes, derivatives thereof, and salts thereof.

5. The method of claim 1 wherein said valve metal oxide film coating is removed in step (a) by means of an acid etch.

6. The method of claim 5 wherein the acid used in said acid etch is selected from the group consisting of hydrochloric acid, sulfuric acid, oxalic acid, or hydrofluoric acid.

7. The method of claim 1 wherein said plating solution additionally contains a wetting agent.

8. The method of claim 7 wherein said wetting agent is a sulfonic acid salt.

9. The method of claim 1 wherein said plating solution additional contains a complexing agent.

10. The method of claim 9 wherein said complexing agent is ethylenediaminetetraacetic acid salts or amines.

11. The method of claim 1 wherein said plating solution contains a precious metal content of between about 0.01 to about 100 grams per liter.

12. The method of claim 1 wherein the pH of said plating solution is from about 0.05 to about 4.0.

13. The method of claim 1 wherein step (c) is carried out at a temperature from about 5° C. to 150° C.

14. The method of claim 1 wherein about 15% to about 90% of surface area of said substrate is plated with said electrocatalytic precious metal.

15. The method of claim 1 wherein plated electrode after removing step (d) and before rinsing step (e) is neutralized of any acidity by immersion into a dilute alkali bath.

16. The method of claim 1 wherein said rinsing step is carried out with deionized water.

17. The method of claim 1 wherein plated electrode is treated to enhance the adhesion of the precious metal coating to the electrode substrate, said treatment selected from the group consisting of heat annealing under a vacuum, alloying under a vacuum, chemical treatments, and a second plating procedure.

* * * * *